US005435813A

United States Patent [19]

Evans

[11] Patent Number: 5,435,813

[45] Date of Patent: Jul. 25, 1995

[54] WET BULK DENSITY CONTROL OF FINE AGGREGATES

[76] Inventor: Joseph M. Evans, Box 49, R.D. 3, Export, Pa. 15632

[21] Appl. No.: 170,859

[22] Filed: Dec. 21, 1993

Related U.S. Application Data

[63] Continuation-in-part of Ser. No. 818,117, Jan. 8, 1992, abandoned.

[51] Int. Cl.[6] ..... C10L 9/10

[52] U.S. Cl. ..... 44/620; 44/626; 44/553; 201/20

[58] Field of Search ..... 44/620, 626, 621, 553; 201/9, 20, 41

[56] References Cited

U.S. PATENT DOCUMENTS

| | | | |
|---|---|---|---|
| 1,376,706 | 5/1921 | Kratochwill . | |
| 2,378,420 | 6/1945 | Lohr et al. | 202/33 |
| 3,298,804 | 1/1967 | Schoch | 44/6 |
| 3,563,714 | 2/1971 | Brewer | 44/6 |
| 3,900,611 | 8/1975 | Corbett et al. | 427/214 |
| 4,214,875 | 7/1980 | Kromrey | 44/6 |
| 4,264,333 | 4/1981 | Shaw et al. | 44/620 |
| 4,304,636 | 12/1981 | Kestner et al. | 201/20 |
| 4,316,811 | 2/1982 | Burns et al. | 252/88 |
| 4,331,445 | 5/1982 | Burns | 44/6 |
| 4,450,046 | 5/1984 | Rice et al. | 201/20 |
| 4,735,707 | 4/1988 | Bustamante | 209/5 |
| 4,830,637 | 5/1989 | Wasson | 44/550 |
| 4,867,613 | 9/1989 | McLeod et al. | 405/263 |
| 4,902,565 | 2/1990 | Brook | 428/315.5 |

OTHER PUBLICATIONS

Shuttleworth, D., *Mine and Quarry*, "Superabsorbents in mining and mineral processing", vol. 18:7/8, pp. 47–48, Jul–Aug. 1989.

Svitlyi, Yu G., *Ygol' Ukr.*, "Ways of intensifying water removal from coal transported by pipelines", vol. 2, pp. 38–39, Feb. 1983.

*Primary Examiner*—Margaret Medley

*Attorney, Agent, or Firm*—Jacobson, Price, Holman & Stern

[57] ABSTRACT

Methods and compositions are provided for increasing packed bulk density of coal, whose surface moisture varies from 2 to 15 weight percent, to desired levels in the range of 45 to 50 lbs./cu.ft., and for controlling and maintaining the improved bulk density. The method involves treating the coal with dilute water solutions (0.01 to 1.0 weight percent of solids) of water soluble, nontoxic polymers, belonging to the classes of polyethylene oxides and polyacrylamides, in amounts between 0.5 gram and 120 grams of polymer solids per metric ton of coal.

22 Claims, 1 Drawing Sheet

WET BULK DENSITY CONTROL OF FINE AGGREGATES

This application is a continuation-in-part of application Ser. No. 07/818,117, filed Jan. 8, 1992, now abandoned.

BACKGROUND OF THE INVENTION

1. Field of the Invention

This invention relates to a process in which a solid mineral hydrocarbonaceous material is treated by a chemical process to improve its value as a fuel and to the product resulting from such a process. 2. Description of Related Art It is important to control the bulk density of coal used as feed in two important industrial applications: the manufacture of coke used in steel production, and as power plant and boiler fuel.

Coal is ground to achieve a dense packing. The coal is washed with water to remove excess sulfur and stored in exterior storage piles. Removal of sulfur is essential to preventing air pollution associated with consumption of high sulfur coal. Such coal commonly has a moisture content between 2 and 15% by weight. This addition of water reduces the packing density of the coal. Thus, the bulk density of wet coal is considerably less than that of dry coal ground to the same specification.

Coking is the destructive distillation of coal in the absence of air. This process is effected in large coke ovens or retorts commonly of the slot oven type. In these ovens, finely divided coal is poured through the top of the ovens, sealed, and heated until the distillates are driven off.

Power plants also use ground coal which has been washed with water to remove sulfur which contributes to air pollution. It is essential to maintain the bulk density of boiler feed coal in power plants within a narrow range independent of the moisture content. This minimizes the adjustment of firing controls and maintains peak boiler efficiency.

In order to improve the bulk density of wet coal, some coke oven installations use a preheating process. The wet coal is heated until the moisture is driven off and this dried coal is then placed in the oven where it forms a highly dense mass. This process is expensive in capital and operating costs.

A more common method of increasing the bulk density of wet coal is to add a bulk density control medium to the wet coal. Commonly used media include recycled oil, #2 fuel oil, fuel oil and a surfactant, or a surfactant alone.

U.S. Pat. No. 2,378,420 issued Jun. 19, 1945 to F. A. Lohr et al, "Regulating the Bulk Density of Coke Over Charges", teaches that moist coal containing more than 1% weight moisture can be coated with small quantities of an oil to increase the wet bulk density of the coal. Lohr et al also teach that the wet bulk density of coal can be adjusted by spraying the surfaces of the coal with a free flowing liquid containing a wetting agent.

U.S. Pat. No. 3,563,714, issued Feb. 16, 1971 to Arthur G. Brewer, teaches a composition of matter used for controlling the bulk density of coal with comprises a combination of petroleum oil, water and a surfactant or mixture of surfactants.

U.S. Pat. No. 4,214,875, issued Jul. 29, 1980 to Kromrey, teaches treatment of exposed coal piles with polymers including polyethylene in combination with wax tars or pitch and solid fillers. The coating protects coal piles from the physical loss of coal.

U.S. Pat. No. 4,304,636, issued Dec. 8, 1981 to Kestner et al, teaches a method for controlling the bulk density and throughput characteristics of coking coal by treating the coal with a surfactant and a combination of fuel oil and alcohol or a solid lubricant and water.

U.S. Pat. No. 4,331,445, issued May 25, 1982 to Burns, teaches prevention of spontaneous combustion of coal by treatment with an aqueous solution of polyethylene oxide of at least 2% by weight followed by drying of the coal.

U.S. Pat. No. 4,450,046, issued May 22, 1984 to Rice et al, teaches spraying the surface of the coal with an aqueous dispersion of a surfactant to increase the wet bulk density.

There has been a long-felt and unfilled need for low cost processes for increasing and controlling the bulk density of wet coal. The present invention met this need.

SUMMARY OF THE INVENTION

It has been discovered than effective and inexpensive bulk density control of wet coal may be accomplished by mixing the coal with bulk density control media comprised of aqueous solutions of polyacrylamide, polyethylene oxide, or solutions containing both of these polymers. These polymers have high molecular weights, are water soluble, and are non-polluting.

The mechanism of action of these polymer solutions in increasing the bulk density of wet coal is unknown, but is thought to be due to the interaction of the wet coal particles with lipophilic-hydrophilic groups in polyacrylamide, and with the general interfacial characteristics of polyethylene oxide.

It is an object of this invention to provide processes which increase the bulk density of coal used in making coke.

It is another object of this invention to provide processes which allow control of the coke coal bulk density.

It is another object of this invention to provide processes which increase the weight of coal which may be processed in a coke oven in a single batch.

It is another object of this invention to provide processes which increase the thermal conductivity of the coke oven charge by increasing the coal bulk density.

It is another object of this invention to provide processes which increase the throughput and efficiency of a coke oven.

It is another object of this invention to provide processes which increase coke stability by increasing the bulk density of the coal used in making coke.

It is another object of this invention to provide processes which increase the burden of iron and limestone which may be supported in a blast furnace by providing coke of increased stability.

It is another object of this invention to provide processes for preventing damage to a coke oven from excessive wall pressures associated with coal of excessive bulk density.

It is another object of this invention to provide processes for increasing the density of power plant and boiler feed coal.

It is another object of this invention to provide processes for maintaining peak boiler efficiency in power plants through provision of coal within a narrow range of bulk densities independent of the moisture content of the coal.

It is another object of this invention to provide processes for controlling coal bulk density using extremely small amounts of very low cost water soluble polymers.

It is a final object of this invention to provide processes which raise and control the bulk density of coal in a manner which is inexpensive, effective, and environmentally benign.

These and other objects of this invention will become readily apparent from the following specification in conjunction with the accompanying drawings.

DESCRIPTION OF THE PREFERRED EMBODIMENTS

Figure 1:
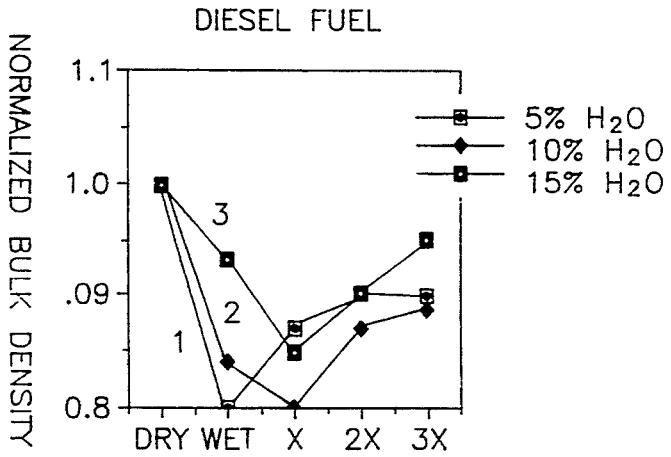
FIG. 1 shows the effects of addition of diesel fuel on the normalized bulk density of coal containing 5%, 10%, and 15% by weight water.

The term "wet coal" in this application means coking coal or power plant and boiler feed coal which has been ground or pulverized and treated with water. The presence of water on the surface of the fine coal particles reduces the bulk density of the coal. Such wet coal has a water content between 2% and 15% by weight.

The bulk density of wet coal may be increased to desired levels in the range of 45 to 50 lbs./cu.ft. by treating the coal with aqueous solutions of polyacrylamide or of polyethylene oxide or of mixtures of these two polymers.

Acrylamide readily undergoes vinyl polymerization to give a large variety of homopolymers and copolymers of controllable molecular weights and performance characteristics. Polyacrylamide is a white solid soluble in water, and generally insoluble in organic solvents. Polyacrylamide is a linear polymer having a head-to-tail structure. A significant amount of branching results when acrylamide is polymerized at temperatures over 50° C.

Polyacrylamides are readily water soluble over a broad range of conditions. The polymers of acrylamide are unique in their strong hydrogen bonding, linearity, and very high molecular weights. Polymers which are predominantly acrylamide are generally classed as polyacrylamides. These polymers are usually sold as water solutions or powders. Polyacrylamides have found utility as dry strength resins, as flocculents in water clarification and mining application, as flooding aids in secondary oil recovery, and as binders for foundry sand.

The weight average molecular weights of polyacrylamide useful in this invention range from about $1.5\times10^3$ to $15\times10^6$ preferably from about $2\times10^4$ to about $7\times10^6$. Aqueous solutions are useful in the range of about 0.01% to about 1.0% polyacrylamide by weight. Many factors are involved in choosing the exact aqueous concentration solution for use with any particular wet coal. Degree of wetness and particle size are factors. In general, lower concentrations are preferable because of lower viscosity and lower cost. A preferred concentration of polyacrylamide in aqueous solution is about 0.1% to about 0.2% by weight.

The aqueous polyacrylamide solution is added to wet coal at an amount equivalent to about 0.5 gram to about 120 grams polyacrylamide per metric ton of wet coal. It is desirable to use polyacrylamide solutions in the lower range to reduce costs. A preferred range of polyacrylamide is from about 4 grams to about 24 grams per metric ton of wet coal.

Polyethylene oxide resins are dry, free-flowing powders completely soluble in water at temperatures up to 98° C. They are non-ionic polymers. The major commercial uses for polyethylene oxide include adhesives, water soluble films, rheology control agents and thickeners, flocculents, dispersants, detergents, control of sewer discharges, and metal-forming lubricants.

The weight average molecular weights of polyethylene oxide useful in this invention range from about $1\times10^5$ to $8\times10^6$, preferably from about $1\times10^5$ to about $6\times10^5$. Aqueous solutions are useful in the range of about 0.01% to about 1.0% polyethylene oxide by weight. Many factors are involved in choosing the exact aqueous concentration solution for use with any particular wet coal. Degree of wetness and particle size are factors. In general, lower concentrations are preferable because of lower viscosity and lower cost. A preferred concentration of polyethylene oxide in aqueous solution is about 0.1% to about 0.2% by weight.

The aqueous polyethylene oxide solution is added to wet coal at an amount equivalent to about 0.5 gram to about 120 grams polyethylene oxide per metric ton of wet coal. It is desirable to use polyethylene oxide solution in the lower range to reduce costs. A preferred range of polyethylene oxide is from about 4 grams to about 24 grams per metric ton of wet coal.

Aqueous solutions containing both polyacrylamide and polyethylene oxide also are useful in this invention. The ratio by weight of polyacrylamide:polyethylene oxide found to be useful ranges from about 10:1 to about 1:10. The total concentration of both polymers in aqueous solution found to be useful ranged from about 0.01% to about 1.0% by weight. The proportions and concentrations of polymers used may be varied depending on the characteristics of the wet coal and the relative costs of the polymers.

The aqueous polymers may be sprayed, poured, or otherwise applied to the wet coal at any stage before the wet coal is placed in the coking oven or fed into the power plant boiler.

EXAMPLES

Examples 1–15 show the effect of fuel oil, aqueous solutions of polyacrylamide (a commercial product available from American Cyanamid Co. under the tradename Magnifloc) at 0.1 and 0.2% by weight, and aqueous solutions of polyethylene oxide (a commercial product available from Union Carbide Corp. under the tradename Polyox WSR 301) at 0.1 and 0.2% by weight as bulk density control media on the bulk density of wet coal containing various amounts of water. The following procedures were used in Examples 1–15.

The tests of the bulk density control methodology were performed using small quantities of coal in a laboratory setting. The coal was obtained from untreated coal storage piles from a local coke plant. The coal was first air dried by periodically turning the coal mass in the presence of forced air current for a minimum of 24 hours. The second step of the process was to pass the coal sample through a ¼ inch screen.

One thousand five hundred grams of the sieved coal was weighed and mixed for 3 minutes in the dry state in a Hobart, Model N-50 mixer. Water was then added to bring the moisture content of the coal to the desired level, and the mixing was continued for an additional 3 minutes.

Previously prepared samples of bulk density control medium (fuel or polymer solutions) were then added to the coal sample in the proper proportions, and the mixing was continued for an additional 3 minutes. The mixing bowl containing the treated coal was then placed on a Soiltest, Model CT-164 vibrating table and a standard container of approximately 500 cc was placed in the mixing bowl. This container was filled with the treated coal sample to overflowing.

The vibrating table was then turned on at a standard setting for 40 seconds. After this period of vibration, the excess coal was removed from the top of the sample container using a straightedge. The sample container containing the vibrated and compacted coal was then weighed.

The volume and weight of the coal sample were obtained by subtracting the weight of the sample container from the weight of the container filled with compacted coal, and measuring the volume of the sample container using standard methods.

The dry bulk density was obtained using the above methodology but omitting the steps of water addition, mixing after the water had been added, and the addition of the bulk control density medium.

Bulk density control media were added to the wet coal at the level of 0, 4, 8, or 12 liters media per metric ton of wet coal.

The bulk density of the coal was computed by the following formula:

$$\text{Bulk density} = \frac{\text{sample wt (grams)}}{\text{sample volume (cc)}} \times 62.4 \text{ (lbs. } H_2O\text{/cu. ft. of } H_2O)$$

Figure 2:
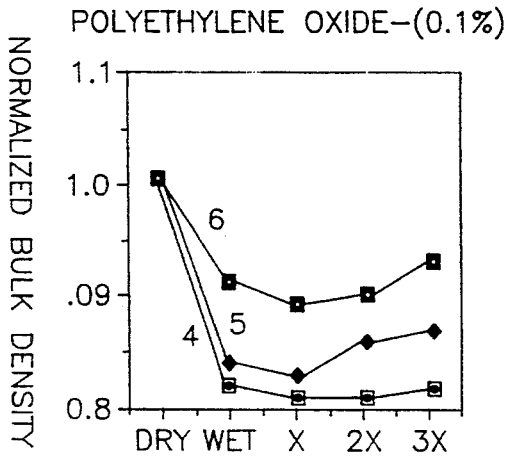
FIG. 2 shows the effects of addition of 0.1% by weight polyethylene oxide aqueous solution on the normalized bulk density of coal containing 5%, 10%, and 15% by weight water.
Figure 3:
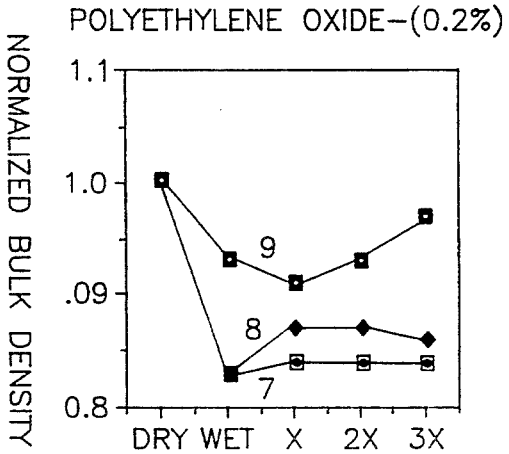
FIG. 3 shows the effects of addition of 0.2% by weight polyethylene oxide aqueous solution on the normalized bulk density of coal containing 5%, 10%, and 15% by weight water.
Figure 4:
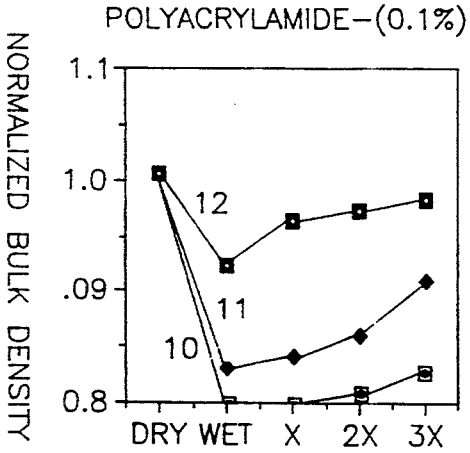
FIG. 4 shows the effects of addition of 0.1% by weight polyacrylamide aqueous solution on the normalized bulk density of coal containing 5%, 10%, and 15% by weight water.
Figure 5:
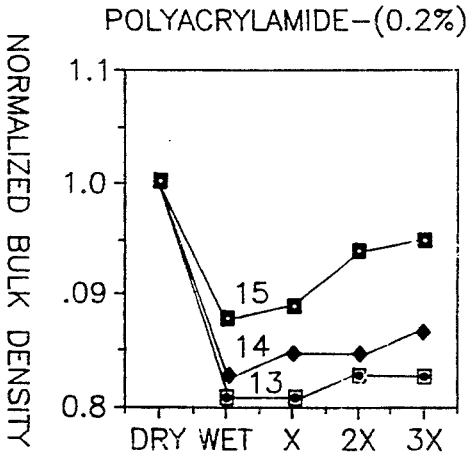
FIG. 5 shows the effects of addition of 0.2% by weight polyacrylamide aqueous solution on the normalized bulk density of coal containing 5%, 10%, and 15% by weight water.

The normalized bulk density was computed within each Example by dividing the bulk density of the experimental sample by the bulk density of the dry sample. FIGS. 1–5 depict the normalized bulk densities on the vertical axis and the sample status on the horizontal axis. The DRY status indicates dry coal to which neither moisture nor bulk density media were added. The WET status indicates coal to which the indicated moisture was added but to which no bulk density medium was added "X", "2X" and "3X" indicate 4, 8 and 12 liters bulk density control media per metric ton of wet coal, respectively. The % by weight added moisture was indicated as follows: 5%, open squares; 10%, closed diamonds; and 15% closed squares The Example number is indicated adjacent the appropriate lines in FIGS. 1–5.

Examples 1–3

Examples 1–3 show the effect of diesel fuel as bulk density control medium on the bulk density of wet coal containing 5%, 10%, or 15% by weight water. The results of Examples 1–3 are listed in Table 1 and shown in FIG. 1. The results of Example 1 indicate that the density of wet coal containing 5% moisture was increased by fuel oil at all concentrations tested. Example 2 shows the density of wet coal containing 10% moisture was lowered by fuel oil at 4 l/M. ton wet coal but raised by fuel oil at 8 and 12 l/M. ton wet coal. Example 3 shows the density of wet coal containing 15% moisture was lowered by fuel oil at 4 and 8 l/M. ton wet coal but raised by fuel oil at 12 l/M. ton wet coal.

Examples 4–6

Examples 4–6 show the effect of 0.1% by weight aqueous solution of polyethylene oxide as bulk density control medium on the bulk density of wet coal containing 5%, 10%, or 15% by weight water. The results of Examples 4–6 are listed in Table 2 and shown in FIG. 2. The results of Example 4 indicate that the density of wet coal containing 5% moisture was decreased by the medium at 4 and 8 l/M. ton wet coal and was restored to the initial value at 12 l/M. ton wet coal. Example 5 indicates that the density of wet coal containing 10% moisture was lowered by the medium at 4 l/M. ton wet coal but raised by the medium at 8 and 12 l/M. ton wet coal. Example 6 indicates that the density of wet coal containing 5% moisture was lowered by the medium at 4 and 8 l/M. ton wet coal but raised by the medium at 12 l/M. ton wet coal.

Examples 7–9

Examples 7–9 show the effect of 0.2% by weight aqueous solution of polyethylene oxide as bulk density control medium on the bulk density of wet coal containing 5%, 10%, or 15% by weight water. The results of Examples 7–9 are listed in Table 2 and shown in FIG. 3. The results of Example 7 indicate that the density of wet coal containing 5% moisture was increased by the medium at all concentrations tested. Example 8 indicates that the density of wet coal containing 10% moisture was increased by the medium at all concentrations tested. Example 9 indicates that the density of wet coal containing 15% moisture was lowered by the medium at 4 l/M. ton wet coal but restored by the medium at 8 l/M. ton wet coal, and raised by the medium at 12 l/M. ton wet coal.

Examples 10–12

Examples 10–12 show the effect of 0.1% by weight aqueous solution of polyacrylamide as bulk density control medium on the bulk density of wet coal containing 5%, 10%, or 15% by weight water. The results of Examples 10–12 are listed in Table 3 and shown in FIG. 4. The results of Example 10 indicate that the density of wet coal containing 5% moisture was unchanged by the medium at 4 l/M. ton wet coal and increased by the medium at 8 and 12 l/M. ton wet coal. Example 11 indicates that the density of wet coal containing 10% moisture was increased by the medium at all concentrations tested. Example 12 indicates that the density of wet coal containing 15% moisture was increased by the medium at all concentrations tested.

Examples 13–15

Examples 13–15 showed the effect of 0.2% by weight aqueous solution of polyacrylamide as bulk density control medium on the bulk density of wet coal containing 5%, 10%, or 15% by weight water. The results of Examples 13–15 are listed in Table 3 and shown in FIG. 5. The results of Example 13 indicate that the density of wet coal containing 5% moisture was unchanged by the medium at 4 l/M. ton wet coal and increased by the medium at 8 and 12 l/M. ton wet coal. Example 14 indicates that the density of wet coal containing 10% moisture was increased by the medium at all concentrations tested. Example 15 indicates that the density of wet coal containing 15% moisture was increased by the medium at all concentrations tested.

In both the polyethylene oxide and polyacrylamide tests the smaller the amount of moisture added, the larger the bulk density drop. In the polyethylene oxide tests, best results were obtained with both 0.1% and 0.2% by weight solutions and wet coal of 15% moisture by weight. In the polyacrylamide tests, best results were obtained with both 0.1% and 0.2% by weight aqueous solutions with wet coal of 15% by weight moisture. The lower concentration of medium is preferred because of less use of polymer. Polyacrylamide is slightly more effective than polyethylene oxide in terms of bulk density recovery.

It will be apparent to those skilled in the art that the examples and embodiments described herein are by way of illustration and not of limitation, and that other examples may be utilized without departing from the spirit and scope of the present invention, as set forth in the appended claims.

TABLE 1

Effect on coal bulk density of the addition of diesel fuel additive in the presence of various amounts of surface moisture

| Example | Surface Moisture (% by Weight) | Additive (1/M. Ton) | Bulk Density (lb/cu ft) | Normalized Bulk Density |
|---|---|---|---|---|
| 1 | 0 | 0 | 51.52 | 1.00 |
| | 5 | 0 | 41.34 | 0.80 |
| | 5 | 4 | 44.90 | 0.87 |
| | 5 | 8 | 46.34 | 0.90 |
| | 5 | 12 | 46.32 | 0.90 |
| 2 | 0 | 0 | 52.12 | 1.00 |
| | 10 | 0 | 43.61 | 0.84 |
| | 10 | 4 | 41.64 | 0.80 |
| | 10 | 8 | 45.37 | 0.82 |
| | 10 | 12 | 46.38 | 0.89 |
| 3 | 0 | 0 | 52.15 | 1.00 |
| | 15 | 0 | 48.45 | 0.93 |
| | 15 | 4 | 44.14 | 0.85 |
| | 15 | 8 | 46.69 | 0.90 |
| | 15 | 12 | 49.38 | 0.95 |

TABLE 2

Effect on coal bulk density of the addition of polyethylene oxide solutions in the presence of various amounts of surface moisture

| Example | Surface Moisture (% by weight) | Polymer Concentration (% by Weight) | Additive (1/M. Ton) | Bulk Density (lb/cu ft) | Normalized Bulk Density |
|---|---|---|---|---|---|
| 4 | 0 | 0.1 | 0 | 51.95 | 1.00 |
| | 5 | | 0 | 42.68 | 0.82 |
| | 5 | | 4 | 42.11 | 0.81 |
| | 5 | | 8 | 42.03 | 0.81 |
| | 5 | | 12 | 42.56 | 0.82 |
| 5 | 0 | 0.1 | 0 | 51.48 | 1.00 |
| | 10 | | 0 | 43.49 | 0.84 |
| | 10 | | 4 | 42.95 | 0.83 |
| | 10 | | 8 | 44.30 | 0.86 |
| | 10 | | 12 | 44.58 | 0.87 |
| 6 | 0 | 0.1 | 0 | 52.09 | 1.00 |
| | 15 | | 0 | 47.23 | 0.91 |
| | 15 | | 4 | 46.18 | 0.89 |

TABLE 2-continued

Effect on coal bulk density of the addition of polyethylene oxide solutions in the presence of various amounts of surface moisture

| Example | Surface Moisture (% by weight) | Polymer Concentration (% by Weight) | Additive (1/M. Ton) | Bulk Density (lb/cu ft) | Normalized Bulk Density |
|---|---|---|---|---|---|
| | 15 | | 8 | 46.91 | 0.90 |
| | 15 | | 12 | 48.68 | 0.93 |
| 7 | 0 | 0.2 | 0 | 50.70 | 1.00 |
| | 5 | | 0 | 42.32 | 0.83 |
| | 5 | | 4 | 42.44 | 0.84 |
| | 5 | | 8 | 42.59 | 0.84 |
| | 5 | | 12 | 42.55 | 0.84 |
| 8 | 0 | 0.2 | 0 | 51.84 | 1.00 |
| | 10 | | 0 | 43.20 | 0.83 |
| | 10 | | 4 | 45.29 | 0.87 |
| | 10 | | 8 | 45.04 | 0.87 |
| | 10 | | 12 | 44.69 | 0.86 |
| 9 | 0 | 0.2 | 0 | 50.77 | 1.00 |
| | 15 | | 0 | 46.99 | 0.93 |
| | 15 | | 4 | 46.15 | 0.91 |
| | 15 | | 8 | 47.11 | 0.93 |
| | 15 | | 12 | 49.04 | 0.97 |

TABLE 3

Effect on coal bulk density of the addition of polyacrylamide solutions in the presence of various amounts of surface moisture

| Example | Surface Moisture (% by weight) | Polymer Concentration (% by Weight) | Additive (1/M. Ton) | Bulk Density (lb/cu ft) | Normalized Bulk Density |
|---|---|---|---|---|---|
| 10 | 0 | 0.1 | 0 | 51.99 | 1.00 |
| | 5 | | 0 | 41.44 | 0.80 |
| | 5 | | 4 | 41.77 | 0.80 |
| | 5 | | 8 | 42.13 | 0.81 |
| | 5 | | 12 | 43.04 | 0.83 |
| 11 | 0 | 0.1 | 0 | 51.84 | 1.00 |
| | 10 | | 0 | 42.83 | 0.82 |
| | 10 | | 4 | 43.62 | 0.84 |
| | 10 | | 8 | 44.66 | 0.86 |
| | 10 | | 12 | 46.95 | 0.91 |
| 12 | 0 | 0.1 | 0 | 51.61 | 1.00 |
| | 15 | | 0 | 47.52 | 0.92 |
| | 15 | | 4 | 49.46 | 0.96 |
| | 15 | | 8 | 50.01 | 0.97 |
| | 15 | | 12 | 50.58 | 0.98 |
| 13 | 0 | 0.2 | 0 | 52.84 | 1.00 |
| | 5 | | 0 | 42.80 | 0.81 |
| | 5 | | 4 | 42.94 | 0.81 |
| | 5 | | 8 | 43.63 | 0.83 |
| | 5 | | 12 | 44.06 | 0.83 |
| 14 | 0 | 0.2 | 0 | 51.63 | 1.00 |
| | 10 | | 0 | 42.75 | 0.83 |
| | 10 | | 4 | 43.98 | 0.85 |
| | 10 | | 8 | 44.03 | 0.85 |
| | 10 | | 12 | 45.00 | 0.87 |
| 15 | 0 | 0.2 | 0 | 52.86 | 1.00 |
| | 15 | | 0 | 46.77 | 0.88 |
| | 15 | | 4 | 47.25 | 0.89 |
| | 15 | | 8 | 49.62 | 0.94 |
| | 15 | | 12 | 50.05 | 0.95 |

What is claimed is:

1. A process for increasing the bulk density of wet coal comprising mixing wet coal with an aqueous solution of a water soluble polymer selected from the group consisting of polyacrylamide, polyethylene oxide and a mixture of polyacrylamide and polyethylene oxide, said aqueous solution being mixed with wet coal in an amount equivalent to about 0.5 gram to about 120 grams of water soluble polymer per metric ton of wet coal, the average molecular weight of polyacrylamide being from about $1.5\times10^3$ to $15\times10^6$ and the average molecular weight of polyethylene oxide being from about $1\times10^5$ to $8\times10^6$, the concentration of water in the wet coal being about 2% to about 15% by weight.

2. The process of claim 1 wherein the water soluble polymer is polyacrylamide having a weight average molecular weight from about $2\times10^4$ to about$7\times10^6$.

3. The process of claim 1 wherein the water soluble polymer is polyacrylamide and the concentration of polyacrylamide in aqueous solution is about 0.01% to about 1.0% by weight.

4. The process of claim 1 wherein the water soluble polymer is polyacrylamide and the concentration of polyacrylamide in aqueous solution is about 0.1% to about 0.2% by weight.

5. The process of claim 1 wherein the concentration of water in the wet coal is about 2% to about 15% by weight.

6. The process of claim 1 wherein the water soluble polymer is polyacrylamide and the aqueous solution of polyacrylamide is added to wet coal in an amount equivalent to about 4 grams to about 24 grams polyacrylamide per metric ton of wet coal.

7. The process of claim 1 wherein the water soluble polymer is polyacrylamide, the concentration of polyacrylamide in aqueous solution is about 0.1% by weight and the aqueous solution of polyacrylamide is added to wet coal at an amount equivalent to about 4 grams to about 24 grams polyacrylamide per metric ton of wet coal.

8. The process of claim 1 wherein the water soluble polymer is polyethylene oxide having a weight average molecular weight from about $1\times10^5$ to about $6\times10^5$.

9. The process of claim 1 wherein the water soluble polymer is polyethylene oxide and the concentration of polyethylene oxide in aqueous solution is about 0.01% to about 1.0% by weight.

10. The process of claim 1 wherein the water soluble polymer is polyethylene oxide and the concentration of polyethylene oxide in aqueous solution is about 0.1% to about 0.2% by weight.

11. The process of claim 1 wherein the water soluble polymer is polyethylene oxide and the aqueous solution of polyethylene oxide is added to wet coal at an amount equivalent to about 4 grams to about 24 grams polyethylene oxide per metric ton of wet coal.

12. The process of claim 1 wherein the water soluble polymer is polyethylene oxide, the concentration of polyethylene oxide in aqueous solution is about 0.1% by weight and the aqueous solution of polyethylene oxide is added to wet coal at an amount equivalent to about 4 grams to about 24 grams polyethylene oxide per metric ton of wet coal.

13. The process of claim 1 wherein the water soluble polymer is a mixture of polyacrylamide and the polyethylene oxide, the ratio by weight of polyacrylamide:-polyethylene oxide being from 10:1 to 1:10.

14. The process of claim 1 wherein water soluble polymer is a mixture of polyacrylamide and polyethylene oxide and the total concentration of polyacrylamide and polyethylene oxide in aqueous solution is about 0.01% to about 1.0% by weight.

15. The process of claim 1 wherein the water soluble polymer is a mixture of polyacrylamide and polyethylene oxide, the ratio by weight of polyacrylamide:-polyethylene oxide is from 10:1 to 1:10, the total concentration of polyacrylamide and polyethylene oxide in aqueous solution is about 0.01% to about 1.0% by weight.

16. A process for increasing the bulk density of wet coal to about 45 to 50 lbs./cu.ft. consisting essentially of mixing wet coal with an aqueous solution of a water soluble polymer selected from the group consisting of polyacrylamide, polyethylene oxide and a mixture of polyacrylamide and polyethylene oxide, said aqueous solution being mixed with wet coal in an amount equivalent to about 0.5 gram to about 120 grams of water soluble polymer per metric ton of wet coal, the average molecular weight of polyacrylamide being from about 1.5 to $10^3$ to $15\times10^6$ and the average molecular weight of polyethylene oxide being from about $1\times10^5$ to $8\times10^6$, the concentration of water in the wet coal being about 2% to about 15% by weight.

17. The process of claim 16 wherein the water soluble polymer is polyacrylamide and the concentration of polyacrylamide in aqueous solution is about 0.01% to about 1.0% by weight.

18. The process of claim 17 wherein the aqueous solution of polyacrylamide is added to wet coal in an amount equivalent to about 4 grams to about 24 grams polyacrylamide per metric ton of wet coal.

19. The process of claim 16 wherein the water soluble polymer is polyethylene oxide and the concentration of polyethylene oxide in aqueous solution is about 0.01% to about 1.0% by weight.

20. The process of claim 19 wherein the aqueous solution of polyethylene oxide is added to wet coal at an amount equivalent to about 4 grams to about 24 grams polyethylene oxide per metric ton of wet coal.

21. The process of claim 16 wherein the water soluble polymer is a mixture of polyacrylamide and the polyethylene oxide, the ratio by weight of polyacrylamide:-polyethylene oxide being from 10:1 to 1:10.

22. The process of claim 21 wherein the total concentration of polyacrylamide and polyethylene oxide in aqueous solution is about 0.01% to about 1.0% by weight.

* * * * *